US009546526B2

(12) United States Patent
Li et al.

(10) Patent No.: US 9,546,526 B2
(45) Date of Patent: Jan. 17, 2017

(54) TORQUE WRENCH APPARATUS AND METHOD FOR MAKING AND BREAKING JOINTS

(71) Applicants: Xuejun Li, Beijing (CN); Chen Liu, Beijing (CN); Jie Cui, Beijing (CN)

(72) Inventors: Xuejun Li, Beijing (CN); Chen Liu, Beijing (CN); Jie Cui, Beijing (CN)

( * ) Notice: Subject to any disclaimer, the term of this patent is extended or adjusted under 35 U.S.C. 154(b) by 0 days.

(21) Appl. No.: 14/840,919

(22) Filed: Aug. 31, 2015

(65) Prior Publication Data

US 2016/0369579 A1 Dec. 22, 2016

(30) Foreign Application Priority Data

Jun. 19, 2015 (CN) ..... 2015 1 0345864

(51) Int. Cl.
*E21B 19/16* (2006.01)

(52) U.S. Cl.
CPC ..... *E21B 19/163* (2013.01)

(58) Field of Classification Search
CPC ..... E21B 19/16; E21B 19/161; E21B 19/163
See application file for complete search history.

(56) References Cited

U.S. PATENT DOCUMENTS 4,023,449 A * 5/1977 Boyadjieff ..... E21B 19/10 81/57.16
5,060,542 A * 10/1991 Hauk ..... E21B 19/163 81/57.16
2003/0172514 A1* 9/2003 Penman ..... B23P 19/061 29/426.5
2014/0262329 A1* 9/2014 Fournier ..... E21B 19/161 166/377

* cited by examiner

*Primary Examiner* — James G Sayre
(74) *Attorney, Agent, or Firm* — Hamre, Schumann, Mueller & Larson, P.C.

(57) ABSTRACT

A torque wrench apparatus comprises a top wrench, a bottom wrench, and a middle wrench. The top and bottom wrenches are configured such that either one of them rotates a first joint in a first direction, and the middle wrench is configured to rotate a second joint in a second direction opposite the first direction; or the top and bottom wrenches are configured such that either one of them immobilizes a first joint, and the middle wrench is configured to rotate a second joint in a first direction; or the middle wrench is configured to immobilize a first joint, and the top and bottom wrenches are configured such that either one of them rotates a second joint in a second direction opposite the first direction. A method for making and breaking joints with the apparatus is also introduced.

8 Claims, 5 Drawing Sheets

TORQUE WRENCH APPARATUS AND METHOD FOR MAKING AND BREAKING JOINTS

BACKGROUND OF THE INVENTION

Field of the Invention

Embodiments of this invention relate to a hydraulic tool for oil and gas drilling operations, particularly, a torque wrench apparatus and method for making and breaking tubular joints in drill pipe strings.

Description of the Related Art

Hydraulic tongs have been employed in making and breaking joints in drilling pipe strings instead of manually-operated rig tongs to achieve a higher standard of safety and efficiency in the field of oil and gas drilling operations. However, because the torques generated during making and breaking of the joints are enormous, and the tool contacts corrosive chemicals in mud directly, it is important to introduce a torque wrench apparatus and method for making and breaking joints which is more rugged, more easily maintained, and causes less damage to the joints.

A number of hydraulic apparatuses for making and breaking joints in drill pipe strings are known. Typically, the apparatus is basically composed of an upper tongs, a lower tongs, a torque cylinder and a linkage installed between the upper tongs and the lower tongs. The torque cylinder is installed between the upper tongs and the lower tongs. Each tongs include a similar structure comprising a tongs block, two jaws, a number of dies, and two clamp cylinders. Dies are installed to the jaws, and each jaw is fixed to the rod end of each clamp cylinder, and the clamp cylinders are formed in the tongs block. In operation, the upper tongs clamp the upper joint while the lower tongs clamp the lower joint, and the torque cylinder extends to make up or retracts to break out the joints respectively, wherein the clamp cylinders are pushing the jaws toward the joints so that the teeth of the dies bite into the outer circumference of the joints.

However, the enormous torque generated during making and breaking joints requests an enormous biting force between the dies and the joints to avoid a slippage, and shock loads perpendicular to the rod of the clamp cylinders are usually generated also which may cause failure to the rod seals, and further, the enormous clamping force set for the maximum torque load is excessive for normal making and breaking joints excessively bites the joints. In short, such apparatuses have limited lifetime, are time consuming and difficult to maintain, and cause excessive damage to joints in drill pipe strings.

SUMMARY OF THE INVENTION

The present invention has been made to overcome or alleviate at least one aspect of the above mentioned shortcomings.

Accordingly, it is an object of the present invention to provide a torque wrench apparatus which has a simple and reasonable structure, is rugged, is easily maintained, and minimizes the damage to drill pipe strings during making and breaking.

In an exemplary embodiment of the present invention, there is provided a torque wrench apparatus comprising: a top wrench, a bottom wrench, and a middle wrench installed between said top wrench and said bottom wrench. The top wrench and the bottom wrench are configured such that either one of the top wrench and the bottom wrench rotates a first joint in a first direction, and the middle wrench is configured to rotate a second joint in a second direction opposite the first direction; or the top wrench and the bottom wrench are configured such that either one of the top wrench and the bottom wrench immobilizes a first joint, and the middle wrench is configured to rotate a second joint in a first direction; or the middle wrench is configured to immobilize a first joint, and the top wrench and the bottom wrench are configured such that either one of the top wrench and the bottom wrench rotates a second joint in a second direction opposite the first direction.

In another exemplary embodiment, there is provided a torque wrench apparatus also comprising: a first linkage assembly connecting said top wrench and said middle wrench, and a second linkage assembly connecting said middle wrench and said bottom wrench, wherein said middle wrench is movable on a horizontal plane between and with respect to said top wrench and said bottom wrench.

In a further exemplary embodiment, said first linkage assembly is composed of a first middle shaft, a first arm pivotally connected to said first middle shaft and said top wrench, and a second arm pivotally connected to said first middle shaft and said middle wrench, and said second linkage assembly is composed of a second middle shaft, a third arm pivotally connected to said second middle shaft and said middle wrench, and a fourth arm pivotally connected to said second middle shaft and said bottom wrench.

In a still further exemplary embodiment, there is provided a torque wrench apparatus also comprising a torque cylinder, said torque cylinder is composed of a body and a rod, and said rod is able to extend or retract with respect to said body, and said top wrench and said bottom wrench as a whole is pivotally connected to said body, and said middle wrench is pivotally connected to said rod.

In a still further exemplary embodiment, each of said top wrench, said middle wrench and said bottom wrench includes an pair of identical tongs, and said tongs are composed of a head block comprising a head and a pigtail, wherein said head and said pigtail are connected through pins, and a hook pivotally connected to said head, and a clamp cylinder pivotally installed between said hook and said pigtail to pivotally turn said hook with respect to said head.

In a still further exemplary embodiment, said head block of said top wrench and said head block of said bottom wrench are pivotally connected to said body of said torque cylinder, and said head block of said top wrench and said head block of said bottom wrench are structurally connected to move synchronously.

In a still further exemplary embodiment, a curved die is installed to said head through dovetail groove connection, and a first flat die and a second flat die are installed to said hook by dovetail groove connection also respectively, wherein said first flat die is configured with a certain angle to said second flat die.

In a still further exemplary embodiment, said head and said hook in each said tongs form a tongs gate (or a pair of jaws), wherein said tongs are standing-by with said jaws open to allow the joints to enter said jaws when said clamp cylinder is extended, and said tongs are grasping the joint when said clamp cylinder retracts to close said jaws, wherein said curved die, said first flat die and said second flat die are clenching on the outer circumference of said joint.

In a still further exemplary embodiment, a three point contact is formed among said curved die, said first flat die, said second flat die, and the periphery of the joint when said tongs clamp a joint, and the axis of the joint goes through the triangle defined by the three contact points, and similar to a pipe tongs, with the dies clenching the outer circumference of the joint, there is no slippage between said tongs and the joint when said tongs delivering torque to the joint.

In a still further exemplary embodiment, there is provided a method of making and breaking joints in drill pipe string with the torque wrench apparatus described above, wherein a first operation of either making or breaking joints by said top wrench and said middle wrench, and a second operation opposite to said first operation of either making or breaking joints by said middle wrench and said bottom wrench.

BRIEF DESCRIPTION OF THE DRAWINGS

The above and other features of the present invention will become more apparent by describing in detail exemplary embodiments thereof with reference to the accompanying drawings, in which.

DETAILED DESCRIPTION OF PREFERRED EMBODIMENTS OF THE INVENTION

Figure 1:
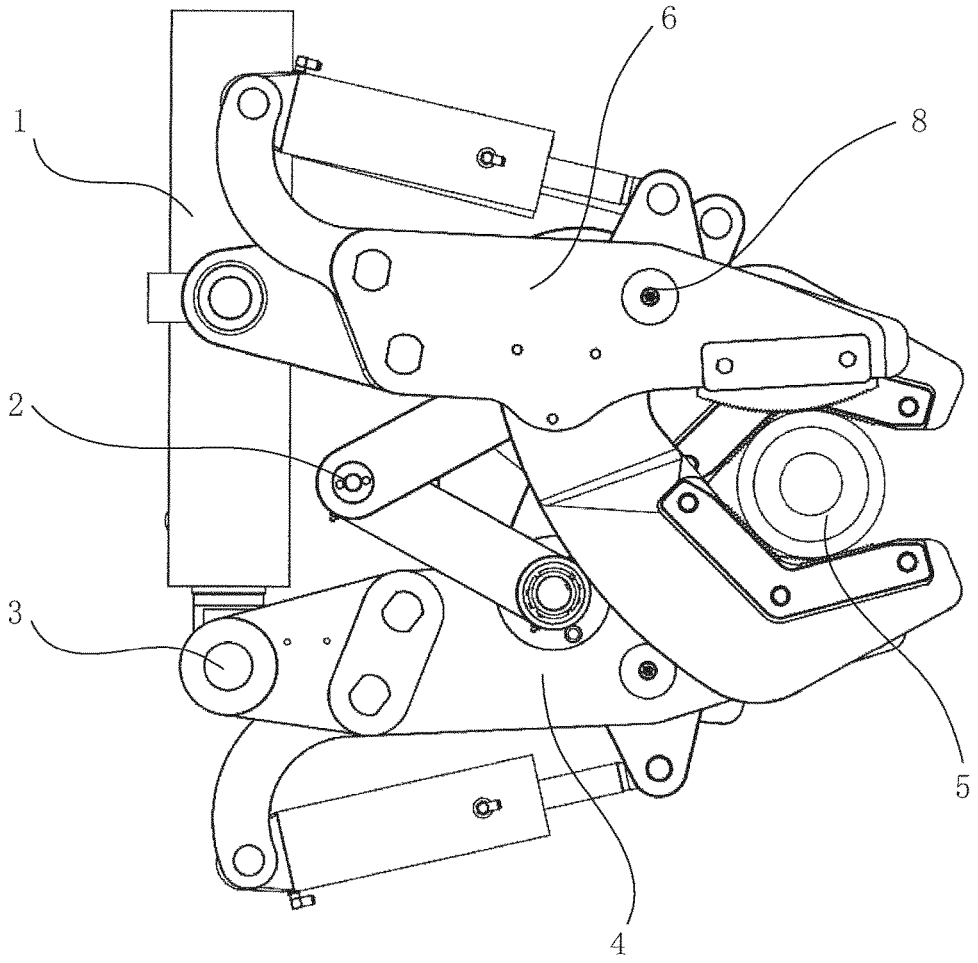
FIG. 1 is an illustrative top view of a torque wrench apparatus in according with a preferred embodiment of the present invention, in which the torque wrench apparatus is grasping on joints in a drill pipe string.

Exemplary embodiments of the present disclosure will be described hereinafter in detail with reference to the attached drawings, wherein the like reference numerals refer to the like elements. The present disclosure may, however, be embodied in many different forms and should not be construed as being limited to the embodiment set forth herein; rather, these embodiments are provided so that the present disclosure will be thorough and complete, and will fully convey the concept of the disclosure to those skilled in the art.

Figure 2:
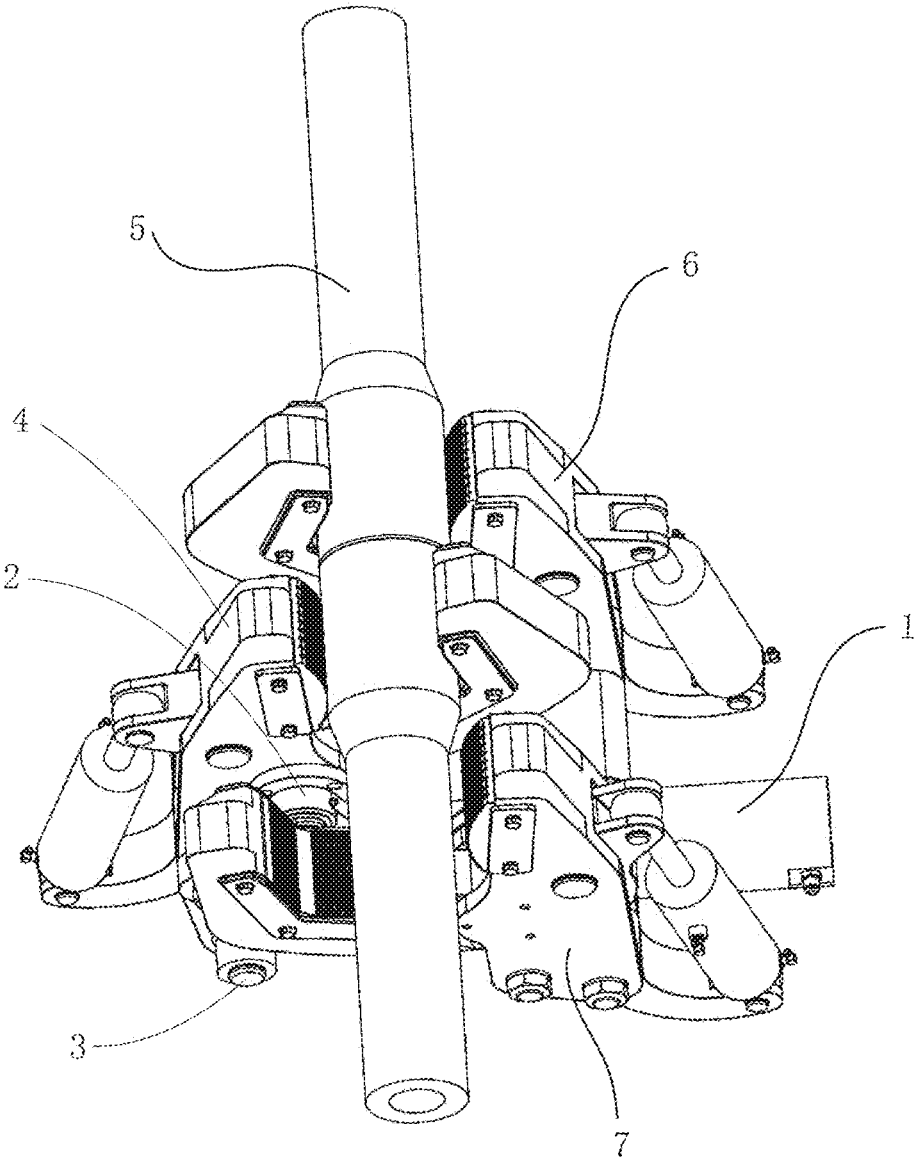
FIG. 2 is an illustrative perspective view of the torque wrench shown in FIG. 1, in which the torque wrench is grasping on joints in a drill pipe string.

Refer to FIG. 1 and FIG. 2, it is illustrated a preferred embodiment of the present invention which relates to a torque wrench apparatus comprising a top wrench 6, a bottom wrench 7 and a middle wrench 4 installed between said top wrench 6 and said bottom wrench 7. The torque wrench apparatus also includes a first linkage assembly 2 and a second linkage assembly 2, which are installed between said bottom wrench 7 and said middle wrench 4, and between said middle wrench 4 and said top wrench 6, respectively.

Figure 3:
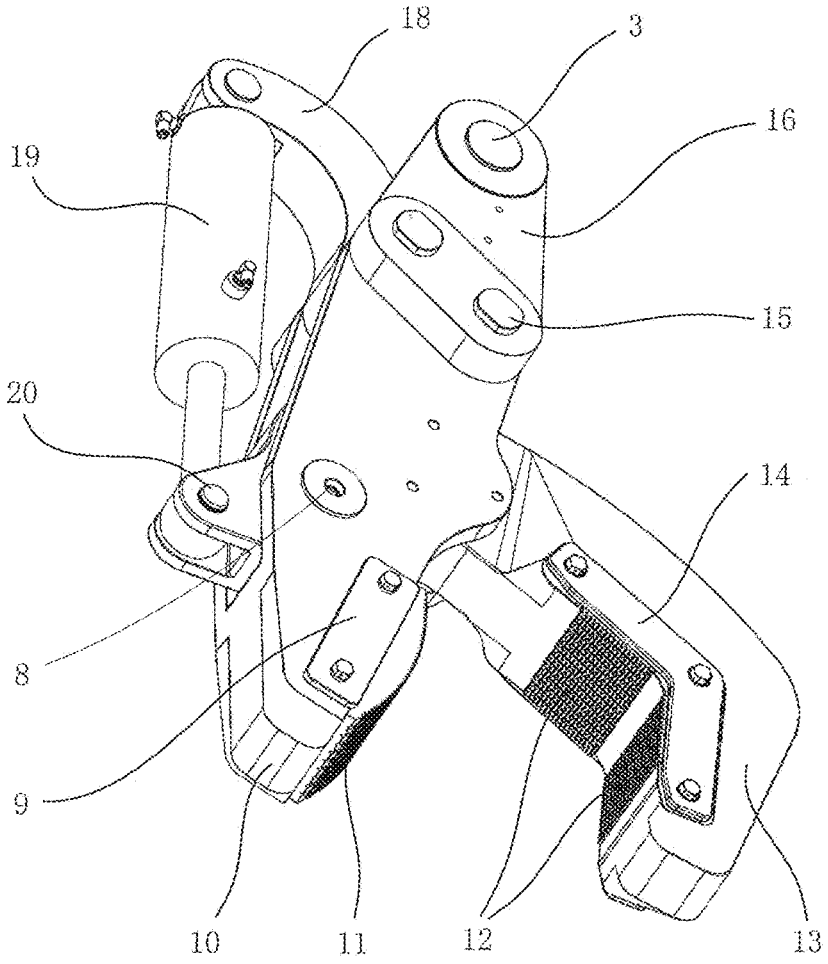
FIG. 3 is an illustrative perspective view of a middle wrench of the torque wrench apparatus shown in FIG. 1.

As shown in FIG. 3, said middle wrench 4 includes a pair of tongs. Said tongs comprise a head block which includes a head 10 and a pigtail 18 connected to said head 10 through two pins 15, a hook 13 which is pivotally mounted to said head 10 through a pin 8, and a clamp cylinder 19 installed between said hook 13 and said pigtail 18 through two pins 20. The opening of said tongs between said head 10 and said hook 13 is called a pair of jaws. The jaws open when said clamp cylinder 19 extends, and close when said clamp cylinder 19 retracts, respectively.

Refer to FIG. 3, there is a curved die 11 installed to said head 10, and there are a first flat die 12 and a second flat die 12 which are in certain angle to each other installed to said hook 13. As shown in FIG. 1, said curved die 11, said first flat die 12 and said second flat die 12 are clenching on the joint of a drill pipe string 5 when said tongs grasping a tubular joint of said drill pipe string 5. Said curved die 11 is installed to said head 10 through dovetail connection (not shown in the attached drawings) which includes a dovetail formed at said curved die 11 and a dovetail groove formed at said head 10. Each of said flat dies 12 is installed to said hook 13 through dovetail connection also (not shown in the attached drawings). Said middle wrench also includes plate 9 and plate 14, which are fixed to said head 10 and hook 13 to remain said curved die 11 and said flat die 12, respectively.

As shown in FIG. 1 again, when said tongs grasps a joint, there are three contact points among the joint of said drill pipe string 5, said curved die 11, said first flat die 12 and said second flat die 12, with the axis of the joints inside the triangle defined by the three contact points. In this way, similar to a pipe wrench, when actuated, said tongs are self-energized to grasp the joint and delivers a desired torque to the joint.

Refer to FIG. 1 and FIG. 3 again, said middle wrench 4 also includes an extension to said tongs opposite the jaws, wherein two links 16 connected to said tongs by two pins 15. There is a pin 3 installed to said links 16, and a torque cylinder 1 is pivotally connected to said middle wrench by said pin 3. As shown in FIG. 3 again, said clamp cylinder 19 pivotally installed between said pigtail 18 and said hook 13 drives said hook 13 to pivotally turn relatively to said head 10. When said clamp cylinder 19 is extended, the jaws are open, and said middle wrench is standing-by. Conversely, the jaws are grasping the joint when said clamp cylinder 19 retracts. It is easy to see that the tongs described are able to grasp joints or tubular pipes in different sizes within a certain range, and there is no need of any adjustment.

Figure 4:
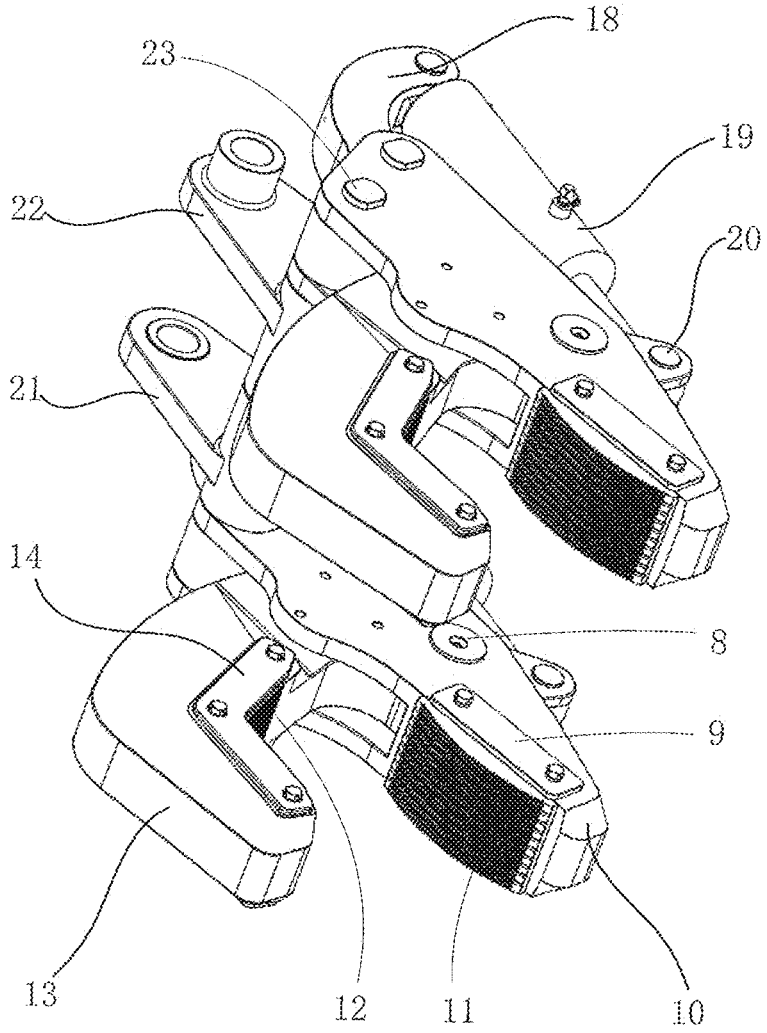
FIG. 4 is an illustrative perspective view of a top wrench and a bottom wrench of the torque wrench apparatus shown in FIG. 1, in which two head blocks of the top wrench and the bottom wrench are structurally configured to move synchronously.

As shown in FIG. 4, each of said top wrench 6 and said bottom wrench 7 includes the same tongs as the pair of said middle wrench 4. However, as shown in FIG. 2, each pair of said tongs of said top wrench 6 and said bottom wrench 7 are configured upside down to said tongs of said middle wrench 4, respectively.

As shown in FIG. 4, said head block of said top wrench 6, said head block of said bottom wrench 7, a link 21 and a link 22 are connected into a whole by two pins 23. Said link 21 and said link 22 form an extension to said top wrench 6 and said bottom wrench 7, and said torque cylinder 1 is pivotally connected between said link 21 and said link 22. Thus, when said torque cylinder 1 extends or retracts, said head block of said top wrench 6 and said head block of said bottom wrench 7 connected in a whole move synchronously.

Also shown in FIG. 4, although the head blocks are connected into a whole, compared to said hook 13 of said top wrench 6, said hook 13 of said bottom wrench 7 is motivated by a different clamp cylinder 19. In this way, said tongs of said top wrench 6 are able to grasp a joint or pipe while said jaws of said bottom wrench 7 are open, or vice versa.

Refer to the preferred embodiment as shown in FIG. 1, FIG. 2, FIG. 3 and FIG. 4, there is a linkage assembly 2 installed between said top wrench 6 and said middle wrench 4, and between said middle wrench 4 and said bottom wrench 7, respectively. Said linkage assemblies secure a vertical position while providing a liberty of the horizontal movement of said middle wrench 4 with respect to said top wrench 6 and said bottom wrench 7.

Figure 5:
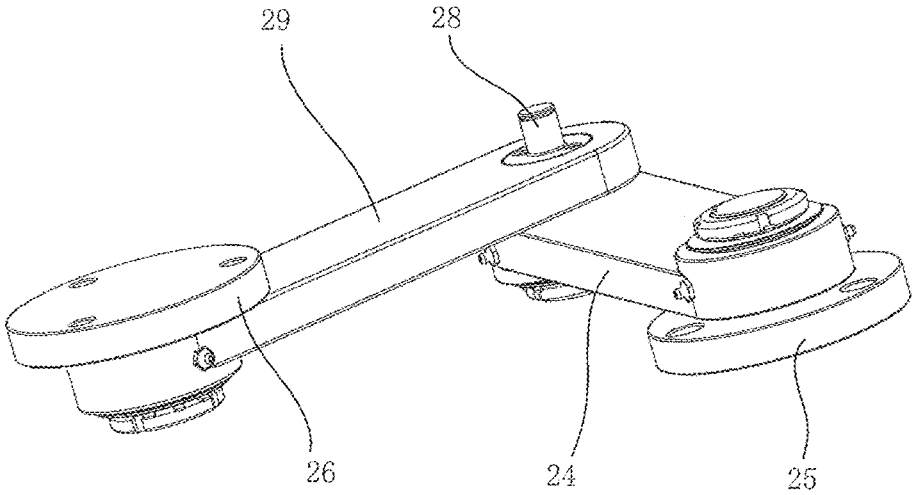
FIG. 5 is an illustrative perspective view of a linkage assembly of the torque wrench apparatus shown in FIG. 1.

Refer to FIG. 5, each said linkage assembly 2 comprises a middle shaft 28, an upper arm 24, a lower arm 29, an upper flange shaft 25, and a lower flange shaft 26. A first end of said upper arm 24 is pivotally connected to said middle shaft 28, and a second end opposite said first end of said upper arm 24 is pivotally connected to said upper flange shaft 25. A first end of said lower arm 29 is secured to said middle shaft 28, and a second end opposite is pivotally connected to said lower flange shaft 26. Each said linkage assembly 2 is installed between said top wrench and said middle wrench or said middle wrench and said bottom wrench through the upper and lower flange shafts 25, 26.

In particular, said upper flange shaft 25 of said linkage assembly 2 between said top wrench 6 and said middle wrench 4 is mounted to said top wrench 6, and said lower flange shaft 26 is fixed to said middle wrench 4. Similarly, said upper flange shaft 25 of said linkage assembly 2 between said middle wrench 4 and said bottom wrench 7 is attached to said middle wrench 4, and said lower flange shaft 26 is attached to said bottom wrench 7.

In a preferred exemplary embodiment of the present invention, there are paired tapered roller bearings applied in the pivotal connections between each arm and each shaft. In this way, each said linkage assembly 2 is able to take loads of both axial and radial at each pivotal connection.

In another preferred exemplary embodiment of the present invention, said upper arm 24 and lower arm 29 have a cross-section of a flat beam, wherein the elastic bending of the beam provides a small scale of vertical movement of said middle wrench 4 with respect to said top wrench 6 and said bottom wrench 7. The pivotal connection configured to take both axial and radial loads secures the parallelism of said middle wrench 4 with respect to said top wrench 6 and said bottom wrench 7, to ensure a good jaws grasping on the joints. In addition, said linkage assembly 2 provides a flexibility to compensate the deviation of tongs' horizontal positioning when grasping joints in drill pipe strings.

The above description of the preferred embodiment related to said linkage assembly 2 is not intended to limit the scope of the present invention, and alternative embodiments will be apparent to those of ordinary skills in the art.

Refer to FIG. 1 and FIG. 2, the tongs of said middle wrench 4 is installed upside down with respect to those of said top wrench 6 and said bottom wrench 7. The body of said torque cylinder 1 is pivotally connected to the extension of the tongs of the top and bottom wrench, and the rod of said torque cylinder 1 is pivotally connected to the extension of the tongs of said middle wrench 4. In particular, the rod of said torque cylinder 1 is connected to said middle wrench 4 by pin 3 and in the same horizontal level as said middle wrench 4, and the body of said torque cylinder 1 is installed between said link 21 and said link 22 connecting said top wrench 6 and said bottom wrench 7.

When the torque wrench apparatus is standing-by, each pair of jaws of said top wrench 6, said middle wrench 4 and said bottom wrench 7 are configured to open to one direction readily to approach and house the joints in a drill pipe string.

As shown in FIG. 1 and FIG. 2, said top wrench 6 is grasping the upper joint in a drill pipe string, and said middle wrench 4 is grasping the lower joint, and said bottom wrench 7 is open and not engaged with the joints. In this situation, it is obvious that the extension of said torque cylinder 1 drives said top wrench 6 to turn the upper joint clockwise with respect to the lower joint, or, drives said middle wrench 4 to turn the lower joint counterclockwise with respect to the upper joint. Thus, there is a making up of the joints in a drill pipe string.

Refer to FIG. 1 and FIG. 2 again, it is apparent in another situation (not shown particularly) that the extension of said torque cylinder 1 actuates said middle wrench 4 to rotate the upper joint counterclockwise with respect to the lower joint, or, actuates said bottom wrench 7 to rotate the lower joint clockwise with respect to the upper joint, wherein said top wrench 6 is open and not engaged with the joints, and said middle wrench is grasping the upper joint, and said bottom wrench 7 is grasping the lower joint. In this way, a breaking out of a joint is achieved.

In all alternative embodiments, there are at least three configurations to make a relative rotation between the upper joint and the lower joint for making or breaking joints in a drill pipe string. First, said top wrench and said bottom wrench are configured to rotate a first joint in a first direction while said middle wrench is configured to rotate a second joint in a second direction opposite said first direction; second, said top wrench and said bottom wrench are configured to immobilize a first joint while said middle wrench is configured to rotate a second joint in a first direction; and third, said middle wrench is configured to immobilize a first joint while said top wrench and said bottom wrench are configured to rotate a second joint in a second direction opposite to said first direction.

The principle, process and method of operation of the torque wrench apparatus according to the embodiment of the present invention is also illustrated with reference to FIG. 1 and FIG. 2.

When the apparatus is standing-by, the jaws of the three wrenches (the tongs gates of said top wrench 6, said middle wrench 4 and said bottom wrench 7) are open with all said clamp cylinders fully extended, and said torque cylinder 1 remains retracted.

When the apparatus conducts a making operation, assuming a drill pipe string in the jaws and with the joints between said top wrench 6 and said middle wrench 4, said clamp cylinder of said top wrench 6 retracts to actuate the jaws (with said curved die installed to said head, and said flat dies installed to said hook) to clamp and grasp the upper joint, and in the meantime, said clamp cylinder of said middle wrench 4 retracts also to have the tongs grasping the lower joint, and the jaws of said bottom wrench 7 remain open with said clamp cylinder not actuated, and then, said torque cylinder 1 extends, driving said top wrench 6 to rotate clockwise with respect to said middle wrench 4, taking the center of the axis of drill pipe string, and said bottom wrench 7 rotates synchronously with said top wrench 6 because said head block of said bottom wrench 7 is structurally connected to said head block of said top wrench 6 as a whole, however, as shown in FIG. 2, said bottom wrench 7 is not engaged with the drill pipe string as the jaws are open; and further, as described above, because each said tongs of the wrenches (said top wrench 6, said middle wrench 4 and said bottom wrench 7) utilize a self-energized grasping mechanism similar to a pipe wrench, there is no slippage between the dies and the joint, and the bigger force said torque cylinder applies to the wrench, the bigger clenching force the tongs apply to the joint. Thus, a making operation for the joints in a drill pipe string is accomplished, wherein the make-up torque is the product of the extension force generated by said torque cylinder 1 and the distance from the center of the joints to the axis of said torque cylinder 1.

Again, assuming that the apparatus is in standing-by situation with a drill pipe string in the jaws, and the joints are positioned between said middle wrench 4 and said bottom wrench 7, we start breaking operation. The jaws of top wrench 6 remain open with said clamp cylinder of said top wrench remaining extended, while both said clamp cylinders of said middle wrench 4 and said bottom wrench 7 retract, so that the jaws of said middle wrench 4 grasp the upper joint, and the jaws of said bottom wrench 7 grasp the lower joint, respectively; then, said torque cylinder 1 extends, driving said middle wrench 4 to rotate counterclockwise with respect to said bottom wrench 7, taking the center of the axis of drill pipe string, and said top wrench 6 rotates synchronously with said bottom wrench 7 but not engaged with the drill pipe string as the jaws are open; and further, as described above, said tongs of the wrenches (said top wrench 6, because said middle wrench 4 and said bottom wrench 7) are configured with a self-energized grasping mechanism similar to a pipe wrench, there is no slippage between the jaws and the joint, and the bigger force said torque cylinder applies to the wrench, the bigger clenching force the jaws apply to the joint. Thus, a breaking operation for the joints of a drill pipe string is achieved, wherein the break-out torque is the product of the extension force generated by said torque cylinder 1 and the distance from the center of the joints to the axis of said torque cylinder 1.

In short, the extension of said torque cylinder 1 makes up joints in drilling strings, when said top wrench 6 and said middle wrench 4 have grasped the upper joint and the lower joint respectively, and, breaks out the joints when said middle wrench 4 and said bottom wrench 7 have grasped the upper joint and the lower joint respectively.

During the making and breaking operations, there is a significant horizontal movement and a small vertical displacement of said middle wrench 4 with respect to said top wrench 6 and said bottom wrench 7. The horizontal movement refers to the relative rotation of the above mentioned wrenches taking the center of the axis of the joints, and the vertical displacement occurs during making up or breaking out the joints with regards to the thread pitch. The three pivotal connections in each said linkage assembly 2 provides the liberty of the horizontal movement, and the elastic flexibility of said upper and lower arms compensates the vertical displacement, and the bearing arrangement, which is able to take both axial and radial loads, secures the parallelism of said middle wrench 4 with regard to said top wrench 6 and said bottom wrench 7.

The torque wrench apparatus according to the embodiment of the present invention consists of certain novel features and structural details, provides a solution of a torque wrench apparatus for making and breaking joints in drill pipe strings which has the following advantages:

Firstly, it is cost efficient to fabricate and maintain the apparatus, because each of the three wrenches (said top wrench 6, said middle wrench 4 and said bottom wrench 7, respectively) of the torque wrench apparatus includes identical tongs.

Secondly, it is convenient to operate the apparatus that the jaws of each wrench grasp joints of different sizes without any need of adjustments or parts changing. In particular, the jaws clamp to a joint through the retraction of said clamp cylinder from a fully open position.

Thirdly, because a self-energized grasping mechanism is applied to each wrench, the clenching force between the dies and the joints is in proportion to the torque at the joints. Thus, the excessive biting damage to the joints is effectively avoided. In operation, said top wrench 6 and middle wrench 4 are applied to make up joints in drill pipe strings, and said middle wrench 4 and bottom wrench 7 are engaged to break out the joints. In particular, when said torque cylinder extends, each pair of jaws grasping on the joint are self-energized, and there is no slippage between the jaws and the joint, and, when said torque cylinder retracts, there is no self-energized grasping between the jaws and the joint, and it is easy to reset the apparatus.

Fourthly, in operation, each said clamp cylinder rotates said hook so that the jaws clamps to pre-grasps the joints, and there is only an axial and limited load applied to said clamp cylinder also because of the self-energized grasping mechanism. In brief, said clamp cylinder is of a long working life due to the reasonable load configuration, and can be easily replaced.

Fifthly, each said curved die or each said flat die is directly installed to said head or said hook, respectively, thus the enormous shock loads generated during making and breaking operations are transferred to the structural bodies directly. In short, the apparatus is able to take heavy torque and related shock loads.

The torque wrench apparatus disclosed herein overcomes the shortcomings of the known hydraulic apparatuses which have limited lifetime, are time consuming and difficult to maintain, and cause excessive damage to the drill pipe strings, and provides a solution for making and breaking joints in drill pipe strings that is rugged, minimizes the repair time, minimizes the damage to the drilling strings during making and breaking operations, and helps to improve the efficiency and safety of oil and gas drilling operations.

Although several exemplary embodiments have been shown and described, it would be appreciated by those skilled in the art that various changes or modifications may be made in these embodiments without departing from the principles and spirit of the disclosure, the scope of which is defined in the claims and their equivalents.

What is claimed is:

1. A torque wrench apparatus, comprising:

a top wrench;

a bottom wrench;

a middle wrench installed between said top wrench and said bottom wrench;

a first linkage assembly connecting said top wrench and said middle wrench; and a second linkage assembly connecting said middle wrench and said bottom wrench, wherein said top wrench and said bottom wrench are configured such that either one of said top wrench and said bottom wrench rotates a first joint in a first direction, and said middle wrench is configured to rotate a second joint in a second direction opposite said first direction;

said top wrench and said bottom wrench are configured such that either one of said top wrench and said bottom wrench immobilizes a first joint, and said middle wrench is configured to rotate a second joint in a first direction; or said middle wrench is configured to immobilize a first joint, and said top wrench and said bottom wrench are configured such that either one of said top wrench and said bottom wrench rotates a second joint in a second direction opposite said first direction, wherein said middle wrench is movable on a horizontal plane with respect to said top wrench and said bottom wrench and between said top wrench and said bottom wrench, wherein said first linkage assembly is composed of:

a first middle shaft;

a first arm pivotally connected to said first middle shaft and said top wrench; and a second arm pivotally connected to said first middle shaft and said middle wrench, and wherein said second linkage assembly is composed of:

a second middle shaft;

a third arm pivotally connected to said second middle shaft and said middle wrench; and a fourth arm pivotally connected to said second middle shaft and said bottom wrench.

2. The torque wrench apparatus according to claim 1, further comprising a torque cylinder;

wherein said torque cylinder includes a body and a rod extendable or retractable with respect to said body;

wherein said top wrench and said bottom wrench as a whole is pivotally connected to said body; and wherein said middle wrench is pivotally connected to said rod.

3. The torque wrench apparatus according to claim 1, wherein each of said top wrench, said middle wrench and said bottom wrench includes a pair of tongs; and wherein each pair of tongs are composed of:

a head block including a head and a pigtail, wherein said head and said pigtail are connected through pins;

a hook pivotally connected to said head; and a clamp cylinder pivotally installed between said hook and said pigtail to pivotally rotate said hook with respect to said head.

4. The torque wrench apparatus according to claim 3, wherein the head block of the top wrench and the head block of the bottom wrench are pivotally connected to said body of said torque cylinder; and wherein said head block of said top wrench and said head block of said bottom wrench are connected to move synchronously.

5. The torque wrench apparatus according to claim 4, wherein a curved die is installed to said head through a dovetail groove connection; and a first flat die and a second flat die are installed to said hook by dovetail groove connections respectively, wherein said first flat die is at a certain angle to said second flat die.

6. The torque wrench apparatus according to claim 3, wherein said head and said hook in each pair of tongs form a pair of jaws, and wherein when said clamp cylinder is extended, said jaws are opened to allow a joint of a drill pipe string to enter said jaws; and when said clamp cylinder retracts, said jaws are closed and the tongs clamp an outer circumference of the joint, such that said curved die, said first flat die and said second flat die clench on the outer circumference of the joint.

7. The torque wrench apparatus according to claim 6, wherein a three-point contact is formed among said curved die, said first flat die, said second flat die, and an outer circumference of the joint when said tongs clamp the joint; and an axis of the joint is located passing through a triangle defined by three contact points of the three-point contact, such that when a torque is applied to the joint by the tongs, the tongs act like a pipe wrench with no slippage between the tongs and the joint.

8. A method of making and breaking joints in drill pipe string by a torque wrench apparatus, the torque wrench apparatus comprising:

a top wrench;

a bottom wrench;

a middle wrench installed between said top wrench and said bottom wrench;

a first linkage assembly connecting said top wrench and said middle wrench; and a second linkage assembly connecting said middle wrench and said bottom wrench, wherein said top wrench or said bottom wrench are configured to rotate a first joint in a first direction while said middle wrench is configured to rotate a second joint in a second direction opposite said first direction;

said top wrench or said bottom wrench are configured to immobilize a first joint while said middle wrench is configured to rotate a second joint in a first direction; or said middle wrench is configured to immobilize a first joint while said top wrench or said bottom wrench are configured to rotate a second joint in a second direction opposite said first direction, wherein said middle wrench is movable on a horizontal plane between and with respect to said top wrench and said bottom wrench, wherein said first linkage assembly is composed of a first middle shaft, a first arm pivotally connected to said first middle shaft and said top wrench, and a second arm pivotally connected to said first middle shaft and said middle wrench, and wherein said second linkage assembly is composed of a second middle shaft, a third arm pivotally connected to said second middle shaft and said middle wrench, and a fourth arm pivotally connected to said second middle shaft and said bottom wrench, the method comprising steps of:

performing one of a joint making operation and a joint breaking operation by said top wrench and said middle wrench; and performing the other of the joint making operation and the joint breaking operation by said middle wrench and said bottom wrench.

* * * * *